United States Patent [19]

Milz

[11] 4,349,311

[45] Sep. 14, 1982

[54] ROTARY PUMP

[76] Inventor: Arthur Milz, Bodenmühle, Wald, Switzerland

[21] Appl. No.: 135,089

[22] Filed: Mar. 28, 1980

[30] Foreign Application Priority Data

Apr. 9, 1979 [CH] Switzerland ..... 3327/79

[51] Int. Cl.[3] ..... F04D 29/44

[52] U.S. Cl. ..... 415/112; 415/207; 415/206

[58] Field of Search ..... 415/206, 207, 204, 219 B, 415/112; 417/424

[56] References Cited

U.S. PATENT DOCUMENTS

| | | | |
|---|---|---|---|
| 11,544 | 8/1854 | Andrews | 415/207 |
| 406,394 | 7/1889 | Forcier | 415/204 |
| 976,565 | 11/1910 | Gray | 415/206 |
| 2,007,856 | 7/1935 | Haldeman et al. | 415/206 X |
| 2,331,641 | 10/1943 | Walker | 415/112 X |
| 2,445,182 | 7/1948 | Odey | 417/424 X |
| 2,910,946 | 11/1959 | Ask | 415/204 |

FOREIGN PATENT DOCUMENTS

| | | | |
|---|---|---|---|
| 676564 | 2/1930 | France | 415/206 |

*Primary Examiner*—Leonard E. Smith

*Attorney, Agent, or Firm*—Ostrolenk, Faber, Gerb & Soffen

[57] ABSTRACT

The disclosure relates to a rotary pump especially for corrosive liquids including an impeller rotating in a working chamber. A spirally wound duct leads from one surface of the working chamber to the outlet pipe of the pump. The upstream end of the duct obliquely enters the working chamber, whereby the end portion of the duct is laterally open towards the chamber and forms a channel in the wall of the chamber. The duct winds helically around the rotation axis of the impeller, having an inside wall at a progressively decreasing radial distance from said rotation axis and a progressively increasing pitch when viewed in the direction of the flow. A feature is the provision of the wound duct in the form of a helix as an open groove formed on the outer surface of a solid stator body and closed by an encompassing casing. A further feature is the provision of a relatively loose, elongated drive shaft from a motor to the pump impeller disposed within a guide tube and a circumferential clearance between the shaft and the tube for leakage flow of liquid being pumped to lubricate the shaft wherein a bypass port is provided in the guide tube for return of the leakage flow upstream of a restriction in the clearance. The restriction increases pressure in the clearance to dampen lateral oscillation of the shaft in the tube. No seals are used for the shaft thereby precluding the tendency of seals to stick during prolonged rest periods.

5 Claims, 3 Drawing Figures

ROTARY PUMP

This invention relates to a rotary pump, especially one with an impeller located in a working chamber intended to be at least partially submerged in the liquid which is to be pumped. There exists a wide variety of such pumps, which serve the most diverse purposes, ranging from bilge water pumping to the removal of chemical products from barrels and similar vessels. Such submerged pumps which as a rule are driven by a motor located above the surface of the liquid, often comprise only a few component parts, require only scant sealings and in consequence necessitate little attention. They are therefore used primarily for pumping dirty or corrosive substances and also where cheapness of construction together with a long, troublefree life is primary. Such uses generally require a reasonable pumping efficiency at low revolutions, such as are available cheaply when the impeller is directly fixed to the shaft of a shaded-pole motor.

Because the above pumps are particularly useful for so-called cask-pumps, which are lowered from above into a vessel, the lateral extension of the pump itself should be as small as possible so that it may also be lowered into vessels having only small apertures or vents.

There exist a number of pumps of this kind, and the Swiss Pat. Nos. 95.098 and 444.673 for instance describe very simple, but rather bulky implementations. Other types, such as are described in Swiss Pat. Nos. 243.663, 450.925 or 599.467 are complicated and do in particular require properly working seals and well-adjusted bearings substantially free of play.

The object of the present invention is to provide a pump of the afore-mentioned type, which avoids these drawbacks and can be built very simply and so as to require little space.

This invention-therefore contemplates a rotary pump having an impeller rotating within a working chamber with a spirally wound duct leading from one frontal surface of the chamber and to the outlet pipe of the pump, where the upstream mouth of the duct obliquely enters the chamber, so as to exhibit an end portion which is laterally open towards the chamber, thus forming a channel in its wall, and where the path of the duct winds helically around the rotation axis of the impeller, winding progressively closer to the axis at a progressively increasing pitch, when viewed in the direction of the flow.

The foregoing object of the invention will be understood from the following description and drawings in which.

Figure 1:
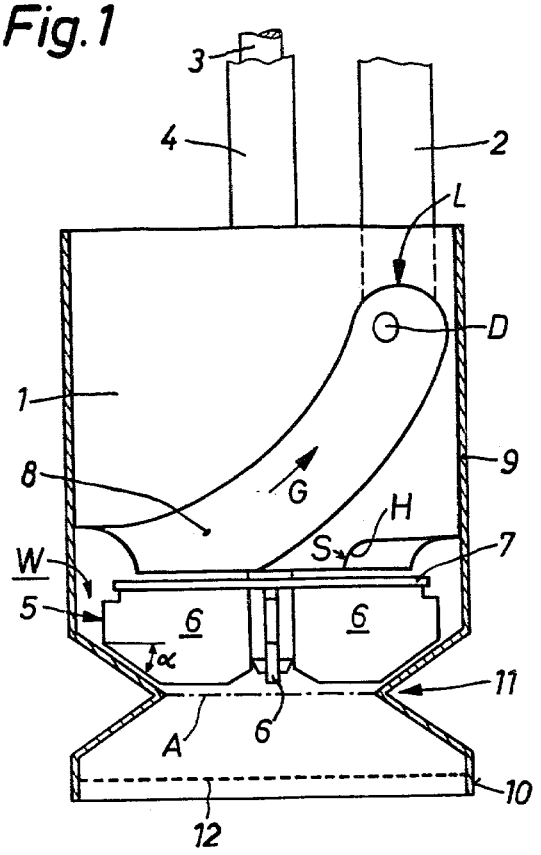
FIG. 1 shows a partial section through an embodiment of the invention.

In FIG. 1, the main body part 1, or stator, which can for instance be made of plastic material in the form of a solid cylinder, and is essentially cylindrical in shape is provided with an outlet pipe 2, and a guide tube 4 which contains the drive shaft 3 of the pump affixed to the upper surface of the stator 1. An electromotor—not shown—is fixed at the upper far end of the guide tube 4 and drives a vane-type impeller 5 through the shaft 3. The arrow F in FIG. 2 indicates the direction of rotation of the impeller. The journal for the lower part of the shaft is formed by a cylindrical passage within the stator 1; because this journal is lubricated by the pumped liquid itself, it can have a comparatively large clearance, or play, of, for instance, about 3/10 mm. As described below, a slight additional pressure may also be exerted on the liquid within this passage. In the simple embodiment, described here, impeller 5 consists of four plane vanes 6 which lie parallel to the shaft 3 and are attached to a circular upper plate 7. The vanes are bevelled at an angle $\alpha$ of about 30° to 50° at their lower, outer corners.

A helical spiral winding or duct 8 is provided within the stator 1 and leads from the peripheral region of the working chamber W surrounding the impeller to the outlet pipe 2, when viewed in the flow direction intended by arrow G. When progressing in this direction, the radical distance of the helix inside wall H from the axis shaft 3 diminishes progressively, and at the same time its pitch increases progressively until it becomes infinite at the upper mouth of the helical duct, thus ensuring a kink-free transition into the pipe 2, which is parallel to the shaft.

Figure 2:
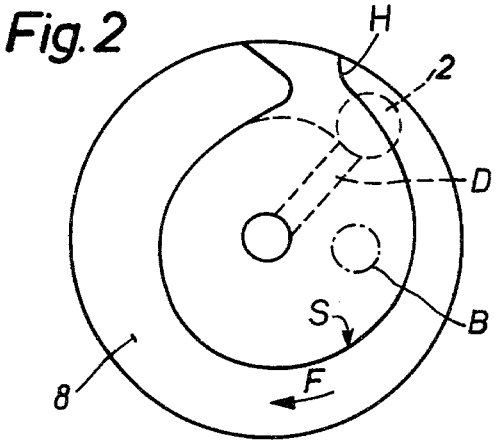
FIG. 2 shows a view of the main body of FIG. 1, as seen from below.

If the duct 8 is obtained by removing material from a solid cylindrical stator, then this duct will generally be manufactured by milling and hence form an open groove at the periphery of said body. It follows, that below point L in FIG. 1, the groove will only form a duct proper once it is closed by an outer wall formed by slipping a casing 9 over the main body. This casing also outwardly limits the working chamber which contains the impeller, and can be shaped to form an inlet mouthpiece 10 for the pump. However, an alternative construction could provide a duct which is closed independently of the existence of an outer casing, for instance by providing a helically wound tube fixed near one end of the chamber and connecting it with the outlet pipe 2. Since the duct 8 varies its distance from the axis of rotation, then as seen in FIG. 2, one entry point of the duct 8 extends over preferably more than 120° since the duct 8 is at its greatest distance from said axis at that area. The pitch of the duct has thus become virtually zero at this point. The duct 18 thereby obliquely enter the chamber as seen particularly in FIG. 1.

In the described embodiment, the casing 9 is made of a metal cylinder slipped over the stator 1 and fixed thereto. The casing is constricted at location 11 under the same angle as the vanes 6 of the impeller. Further down the casing widens again to form an inlet mouth with a rim 10 which carries an inlet filter 12.

In another embodiment, which is not shown separately, but suggested at dotted line A of the drawing, the casing ends at the constriction 11, where it is frontally closed by a plate at the dotted line A. The liquid can then enter the chamber one or more passages bored in the main body 1 and which provide a communication between the chamber and the outside of the pump without interfering with the spirally wound duct. Such a borehole is shown in dash-dotted lines in FIG. 2 and identified by the letter B. This embodiment provides an intake at the upper part of the main body, which is advantageous in some applications.

Figure 3:
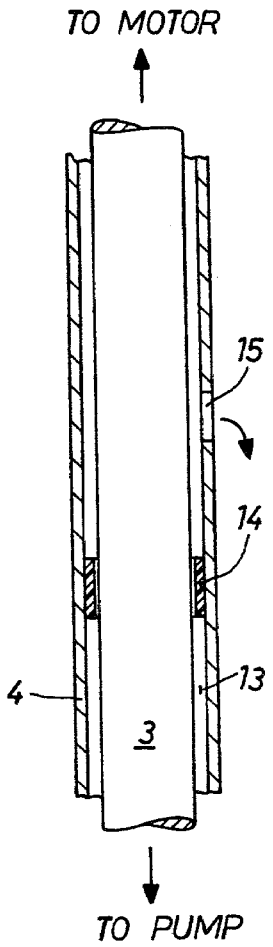
FIG. 3 shows a section of the drive shaft and of its guide.

FIG. 3 shows a section through the shaft 3 which leads from the drive motor (not shown) to the impeller. A guide tube 4 loosely surrounds the shaft 3, with a clearance of for instance ½ mm. The motor is fixed at one end of the tube 4, and the stator 1 at the other end. When the pump is in use, an excess pressure will build up in the upper part of the chamber and, because the shaft is only loosely journalled within the main body, this will force some of the pumped liquid past this journal and into the clearance 13 between the shaft 3 and its guide-tube 4. In order to take full advantage of this liquid layer for damping any sideway movements of the shaft—which often is comparatively long and must be as light as possible—the pressure within the clearance 13 can be increased by providing a pressure equalizing bore D (FIGS. 1 and 2) which joins a point of high pressure inside the duct 8 and the space 13 surrounding the shaft. It is advantageous to preseal the liquid which is to be pumped, which is often corrosive, from rising as far as the motor, without using seals which will tend to stick during prolonged rest periods. To this end the upward flow of liquid can be checked by a drag-piece 14 located in the upper part of the guide-tube 4 and above which is located a recycling port 15. The clearance between the shaft 3 and the drag-piece is about 0.2 mm, ensuring a sufficient increase of pressure below the piece 14 to effectively dampen lateral oscillation of the shaft in the tube. The drag-piece does not form a seal proper, but the liquid which bypasses it can flow back through the port 15 and will thus not reach the motor situated further upwards, which needs therefore not be protected by tight seals. The whole pump thus necessitates neither seals which are in contact with the liquid to be pumped, nor proper bearings, that is, it may comprise only journals with a large amount of play. This allows, among other things, the use throughout of brittle materials, such as glass, which are resistant to corrosive chemicals. If the avoidance of proper seals is not imperative, then the pump-which for clarity has here only been described in a vertical position—may naturally be used in any orientation in space.

I claim:

1. A rotary pump for liquids having a working chamber and an impeller rotating within said working chamber, said chamber having a spirally wound duct leading from one frontal surface of the chamber to the outlet pipe of the pump, the upstream mouth of the duct obliquely entering the chamber and thereby having an end portion which is laterally open towards the chamber and forms a channel in its wall; the path of the duct winding helically around the axis of rotation of the impeller, with a progressively decreasing radial distance from said axis to the inside wall of such duct and a progressively increasing pitch, when viewed in the direction of the flow; including a solid stator and said duct being formed as an open groove on the exterior surface thereof and a casing surrounding said stator and closing said groove.

2. The rotary pump of claim 1, wherein said end portion of said duct is proximate the lateral wall of the chamber and the upstream mouth of the duct extends through at least 180°.

3. The rotary pump of claim 1 wherein the mouth of the duct has a flow area which increases when progressing in the direction of the flow.

4. The rotary pump of claim 1 wherein a drive shaft is provided for said impeller and a passage (D) is provided which leads from a place of high pressure within the duct to the space surrounding the drive shaft of the impeller.

5. The rotary pump of claim 4 wherein a guide tube for said shaft is provided and wherein said shaft driving the impeller is loosely mounted within said guide tube; said guide tube having a lateral exit hole (15) for the liquid.

* * * * *